US006791069B2

(12) United States Patent
Sako et al.

(10) Patent No.: US 6,791,069 B2
(45) Date of Patent: Sep. 14, 2004

(54) HEATER WITH IMPROVED HEAT CONDUCTIVITY

(75) Inventors: Teruhisa Sako, Kyoto (JP); Takaya Nagahata, Kyoto (JP); Hiroaki Hayashi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/183,721

(22) Filed: Jun. 25, 2002

(65) Prior Publication Data

US 2002/0195445 A1 Dec. 26, 2002

(30) Foreign Application Priority Data

Jun. 26, 2001 (JP) ..... 2001-193643

(51) Int. Cl.[7] ..... H05B 3/16
(52) U.S. Cl. ..... 219/543
(58) Field of Search ..... 219/545, 548, 219/216, 543; 399/329, 330, 331, 332, 333

(56) References Cited

U.S. PATENT DOCUMENTS 3,609,294 A * 9/1971 Cady et al. ..... 347/208
3,909,680 A * 9/1975 Tsunashima ..... 361/748
4,710,263 A * 12/1987 Kato ..... 216/27
4,713,530 A * 12/1987 Schittenhelm et al. ..... 219/543
5,068,517 A * 11/1991 Tsuyuki et al. ..... 219/543
5,357,271 A * 10/1994 Wiklof et al. ..... 347/197
5,414,245 A * 5/1995 Hackleman ..... 219/548
5,499,087 A * 3/1996 Hiraoka et al. ..... 399/329
5,587,097 A * 12/1996 Sato et al. ..... 219/543
5,643,483 A * 7/1997 Kubota et al. ..... 219/543
5,822,675 A * 10/1998 Paquet et al. ..... 428/561
6,118,109 A 9/2000 Sako
6,185,383 B1 * 2/2001 Kanari et al. ..... 399/45
6,617,551 B2 * 9/2003 Karube et al. ..... 219/216

* cited by examiner

*Primary Examiner*—Robin O. Evans
*Assistant Examiner*—Vinod Pate
(74) *Attorney, Agent, or Firm*—Merchant & Gould P.C.

(57) ABSTRACT

A heater for fusing toner images onto recording paper is provided. The heater includes a supporting base that has an upper surface and a lower surface. The base has a relatively low thermal conductivity. The heater also includes a heating element formed on the upper surface of the base. A heat conductor is provided on the upper or lower side of the base. The heat conductor has a thermal conductivity greater than the thermal conductivity of the base.

12 Claims, 8 Drawing Sheets

HEATER WITH IMPROVED HEAT CONDUCTIVITY

BACKGROUND OF THE INVENTION

1. Field of the Invention

The present invention relates to a heating device incorporated in e.g. a photocopier for fusing a transferred toner image onto recording paper. It also relates to a method of making such a heating device.

2. Description of the Related Art

Referring to FIGS. 11 and 12 of the accompanying drawings, a conventional heating device (called "heater" below) may have the following structure. The heater 9, as best shown in FIG. 11, includes an elongated supporting base 90 upon which two heating elements 91, 92 are formed to extend longitudinally of the base 90. The heating elements 91, 92 are made by printing and baking an Ag—Pd resistive material for example. Except for the ends 91*a* and 92*a*, the heating elements 91 and 92 are covered by a crystalline glass layer 93 and a noncrystalline glass layer 94, as shown in FIG. 12. The exposed ends 91*a*, 92*a* of the heating elements are connected to an alternator 95. Upon application of the driving voltage, the heating elements generate heat, as required.

In operation, as shown in FIG. 12, recoding paper 96 is held in sliding contact with the outer glass layer 94 by a platen roller 97, so that the transferred toner image is fused onto the recording paper due to the heat generated by the heater 9.

In order to achieve high-speed printing, the recording paper 96 should be quickly heated up to a temperature beyond the melting point of the toner (up to about 230~250° C.) by the heater 9.

If the supporting base 90 has high thermal conductivity, the heat generated by the heating elements will readily be dissipated through the base 90. Accordingly, the paper-contacting portion of the outer glass layer 94 may be cooled rather quickly down to e.g. the room temperature after the fixing unit is switched into the ready mode, where the power supply to the heating elements is temporarily stopped. Due to this, it may take a long time for the paper-contacting portion of the glass layer 94 to be heated up again to the temperature required for fusing the toner image. Apparently, this is disadvantageous to achieving high-speed printing.

If the supporting base 90 has low thermal conductivity, on the other hand, an uneven temperature distribution will result in the base 90 upon application of the driving voltage to the heating elements 91, 92. As a result, the base 90, subjected to an unacceptably great thermal stress, will be cracked or more severely damaged.

SUMMARY OF THE INVENTION

The present invention has been proposed under the circumstances described above. It is, therefore, an object of the present invention to provide a heater that is thermally durable and capable of exhibiting an immediate thermal response.

According to a first aspect of the present invention, there is provided a heater that includes: a supporting base that has a first surface and a second surface opposite to the first surface and has a predetermined thermal conductivity; a heating element formed on the first surface; and a heat conductor having a thermal conductivity greater than the thermal conductivity of the base.

With the use of a heat conductor, the heat diffusion characteristics of the heater is improved to the extent that the supporting base is not thermally damaged, or that the warm-up time of the heater can be shortened than is conventionally possible.

Preferably, the heat conductor may be provided on the side of the second surface or the first surface. Further, the heat conductor may be provided between the first surface and the heating element.

Preferably, the heater of the present invention may further comprise a glass layer interposed between the first surface and the heat conductor.

Preferably, the heater of the present invention may further comprise a heat conduction restrictor having a thermal conductivity lower than the thermal conductivity of the base, wherein the heat conductor is provided on the side of the first surface of the base.

Preferably, the base may be made of an insulating material including $Al_2O_3$, and the heat conductor may be made of an insulating material including one of SiC, AlN, Ag, Al, BN and WC. As another possible example, the base may be made of an insulating material including AlN, while the heat conductor may be made of an insulating material including SiC.

According to a second aspect of the present invention, there is provided a heater that comprises: a supporting base including a first surface and a second surface opposite to the first surface, wherein the base has a predetermined thermal conductivity; a heating element formed on the first surface; and a heat conduction restrictor provided on the side of the second surface and having a thermal conductivity lower than the thermal conductivity of the base.

According to a third aspect of the present invention, there is provided a heater that comprises: a supporting base including a first surface and a second surface opposite to the first surface; and a heating element formed on the first surface of the base. The base includes a first and a second heat conduction restrictors and a heat conductor interposed between the first and the second heat conduction restrictors. The heat conductor is greater in thermal conductivity than the heat conduction restrictors.

According to a fourth aspect of the present invention, there is provided a method of making a heater. The method comprises the steps of: preparing a supporting base including a first surface and a second surface opposite to the first surface, wherein the base has a predetermined thermal conductivity; forming a heating element on the first surface; and providing a heat conductor on the base, wherein the heat conductor has a predetermined thermal conductivity. The thermal conductivity of the heat conductor is made greater than the thermal conductivity of the base.

Preferably, the heat conductor may be formed by sputtering, spraying, plating or screen printing.

Other features and advantages of the present invention will become apparent from the detailed description given below with reference to the accompanying drawings.

DETAILED DESCRIPTION OF THE PREFERRED EMBODIMENTS

Preferred embodiments of the present invention will be described below with reference to the accompanying drawings.

Figure 1:
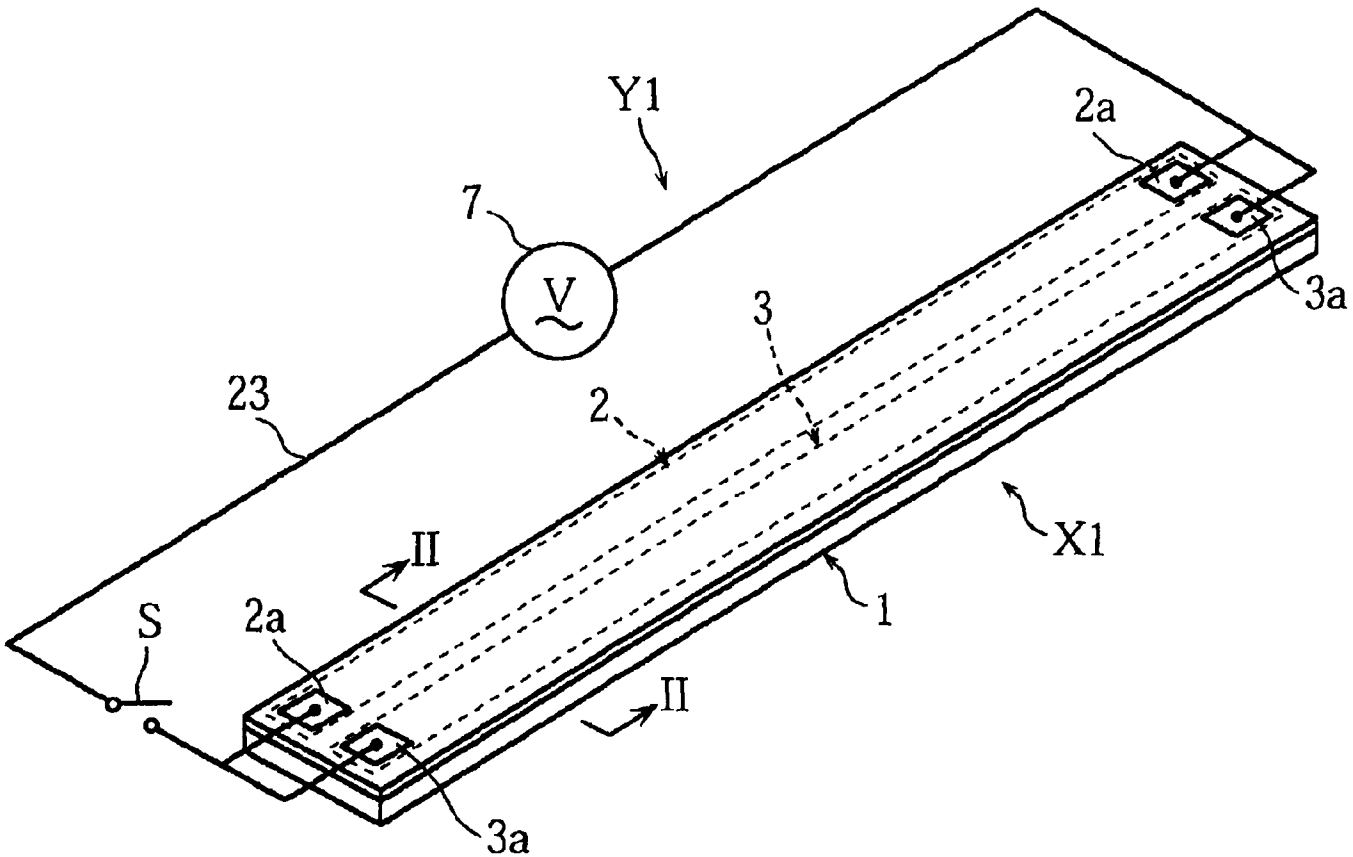
FIG. 1 is a perspective view showing a heater according to a first embodiment of the present invention.
Figure 2:
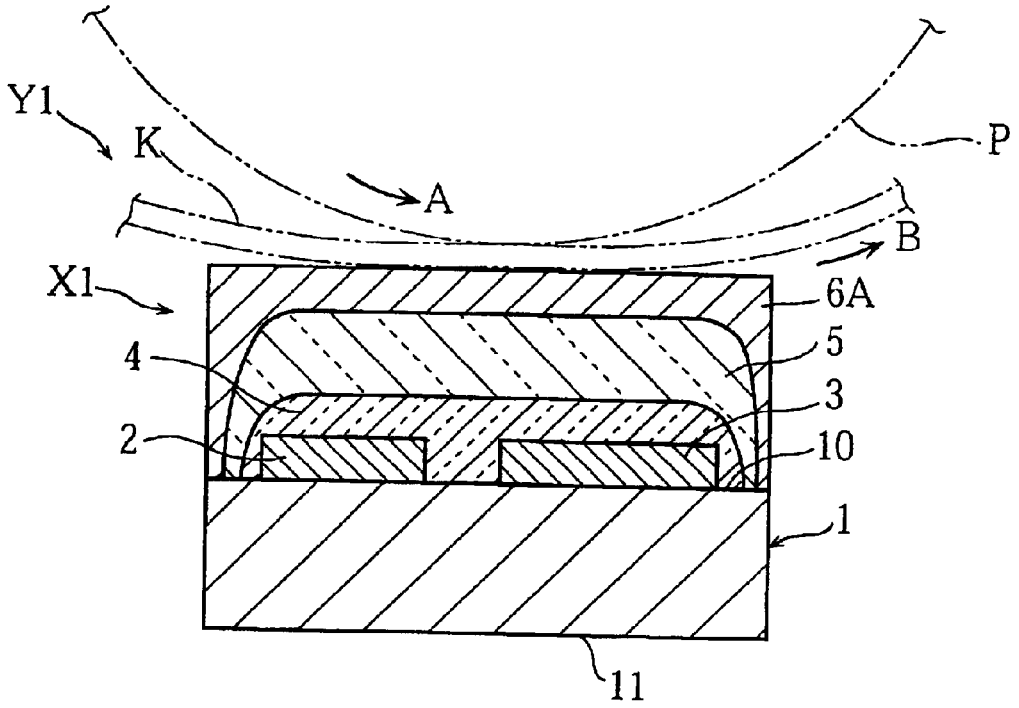
FIG. 2 is a sectional view taken along lines II—II in FIG. 1.

Reference is first made to FIGS. 1 and 2 illustrating a heater according to a first embodiment of the present invention. Typically the heater may be used in a photocopier for the purposes of fusing toner images onto recording paper, though the present invention is not limited to this particular application.

The heater X1, incorporated in a fixing unit Y1 of a photocopier, includes an elongated supporting base 1 having an upper surface 10 and a lower surface 11 opposite to the upper surface 10. A first and a second heating elements 2, 3 of the same length are provided on the upper surface 10 of the base 1.

The heating elements 2, 3 may be formed by printing and baking a resistive paste made of Ag—Pd. As shown in FIG. 2, the first heating element 2 (located upstream of the paper-forwarding direction B from the second heating element 3) is smaller in width than the other heating element 3. Since the heating elements 2, 3 have the same thickness, the first heating element 2 is smaller in cross-sectional area than the second heating element 3. The heating elements 2, 3 are covered by a crystalline glass layer 4, a noncrystalline glass layer 5 and a heat-conducting layer 6A except for the longitudinal ends 2*a* and 3*a*. The outermost layer 6A is made of a material having a high thermal conductivity for achieving efficient heat dissipation.

As shown in FIG. 1, the ends 2*a*, 3*a* of the heating elements 2, 3 are connected to an alternator 7 via wiring 23 in a manner such that the two heating elements 2, 3 are connected in parallel to the power source. The wiring 23 is provided with an analog switch S for closing or opening the circuit. When the switch S is turned on under the control of a controlling unit (not shown), the driving voltage is applied to the heating elements 2, 3 from the alternator 7. Due to the parallel connection, the same voltage is applied to both of the heating elements 2, 3 when the circuit is closed. Since the first heating element 2 has a smaller cross section than the second heating element 3, the former generates more heat than the latter.

The outermost layer 6A may be made of an insulating material such as SiC, AlN, Ag, Al, BN or WC. The supporting base 1 may be made of $Al_2O_3$, so that the layer 6A has a higher thermal conductivity than the base 1. When the base 1 is made of AlN, the layer 6A may be made of SiC.

The outermost layer 6A may be formed by sputtering, thermal spraying, plating or screen printing. By sputtering, the resultant layer 6A will provide a thin, smooth sliding surface for the recording paper K. When the layer 6A is required to have a larger thickness, thermal spraying or screen printing may be employed. The obtained layer 6A may be mechanically processed to provide a smooth sliding surface for the paper K.

The fixing unit Y1, as shown in FIG. 2, includes a platen roller P held in contact with the outermost layer 6A. The platen roller P is rotated in the A-direction by a driving unit (not shown). In operation, the recording paper K is moved in the B-direction, as being held in sliding contact with the layer 6A, to be heated up for fusing the toner image carried on the paper K.

As noted above, the upstream heating element 2 wil generate more heat than the downstream heating element 3, which is advantageous in the following points.

As being fed to the fixing unit Y1, the recording paper K is first brought into contact with an upstream portion of the outermost layer 6A that is generally located immediately above the first heating element 2. Then, the paper K comes into contact with a downstream portion of the same layer 6A that is generally located immediately above the second heating element 3. Supposing now that both the recording paper K and the toner image transferred onto the paper K are initially at the room temperature which is usually way below the melting point of the toner. To achieve high-speed printing, the paper K (and the toner material carried thereon) needs to be heated up quickly to the prescribed toner-melting temperature upon coming into contact with the upstream portion of the outermost layer 6A. This requirement is attained by the greater heat generation of the upstream heating element 2.

In the heater X1, the outermost layer 6A has a greater thermal conductivity than the supporting base 1, whereby the heat energy generated by the heating elements 2, 3 will advantageously be conducted upward to melt the toner on the paper K. Further, due to the great thermal conductivity, the sliding contact surface of the outermost layer 6A is uniformly heated up. Advantageously, this feature allows an increase in paper-nipping width.

In the illustrated embodiment, the thermal conductivity of the glass layers 4 and 5 may be lower than the outermost layer 6A so that some of the heat energy generated by the heating elements 2, 3 can be stored by those inner layers 4, 5. In this way, when the switch S is turned on again for another toner-fusing operation, the temperature of the outermost layer 6A is raised instantaneously by the stored heat energy and the generated heat by the heating elements 2, 3. Further, the base 1 conducts the heat generated by the heating elements 2, 3 toward the outermost layer 6A more swiftly than when the layer 6A is not provided. Accordingly, the base 1 as a whole can be uniformly heated up by the heat from the heating elements 2 and 3, whereby no critically sharp difference in temperature will appear in the base 1. This is advantageous to preventing the base 1 from being damaged by the thermal stress that would otherwise be exerted on the base 1.

Figure 3:
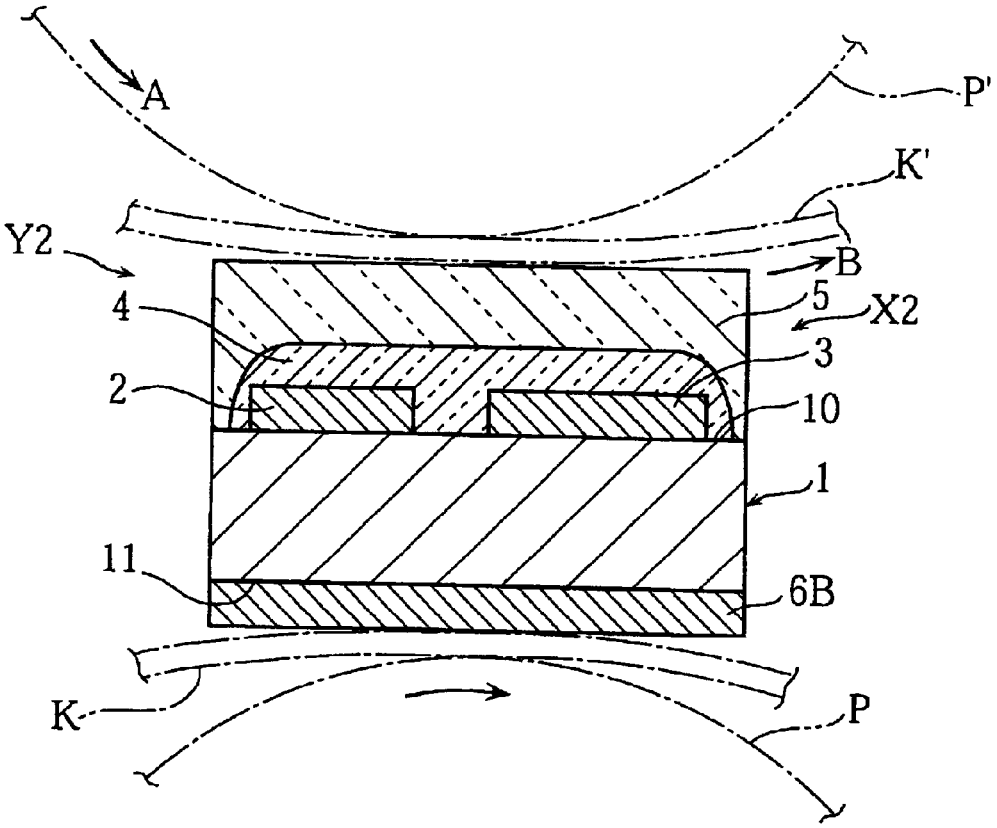
FIG. 3 is a sectional view showing a heater according to a second embodiment of the present invention.

Reference is now made to FIG. 3 illustrating a heater X2 (and fixing unit Y2) according to a second embodiment of the present invention. In this and subsequent embodiments described below, elements identical or similar to those of the first embodiment discussed above are indicated by the same reference numerals.

In the illustrated heater X2, the lower surface 11 of the supporting base 1 is covered by a heat conducting layer 6B made of a material having a high thermal conductivity. The heat conducting layer 6B may be made of the same material as used for the outermost layer 6A of the first embodiment.

Due to the high thermal conductivity of the layer 6B, the heat generated by the heating elements 2, 3 is more efficiently led to the layer 6B via the supporting base 1 than when no such conducting layer. The supporting base 1 itself may have a lower thermal conductivity than the layer 6B.

Like the heater X1 of the first embodiment, the heater X2 may be used for fusing a toner image onto recording paper. In a toner-fusing operation, as shown in FIG. 3, recording paper K (depicted in single-dot chain lines) is held in sliding contact with the heat conducting layer 6B.

Alternatively, the thermal conductivity of the layer 6B is made smaller than that of the supporting base 1. In this example, recording paper is brought into sliding contact with the outermost glass layer 5 by a platen roller P' (depicted in double-dot chain lines in FIG. 3). This arrangement is taken because the less heat-conductive layer 6B tends to direct the toner-fusing heat upward rather than downward.

Figure 4:
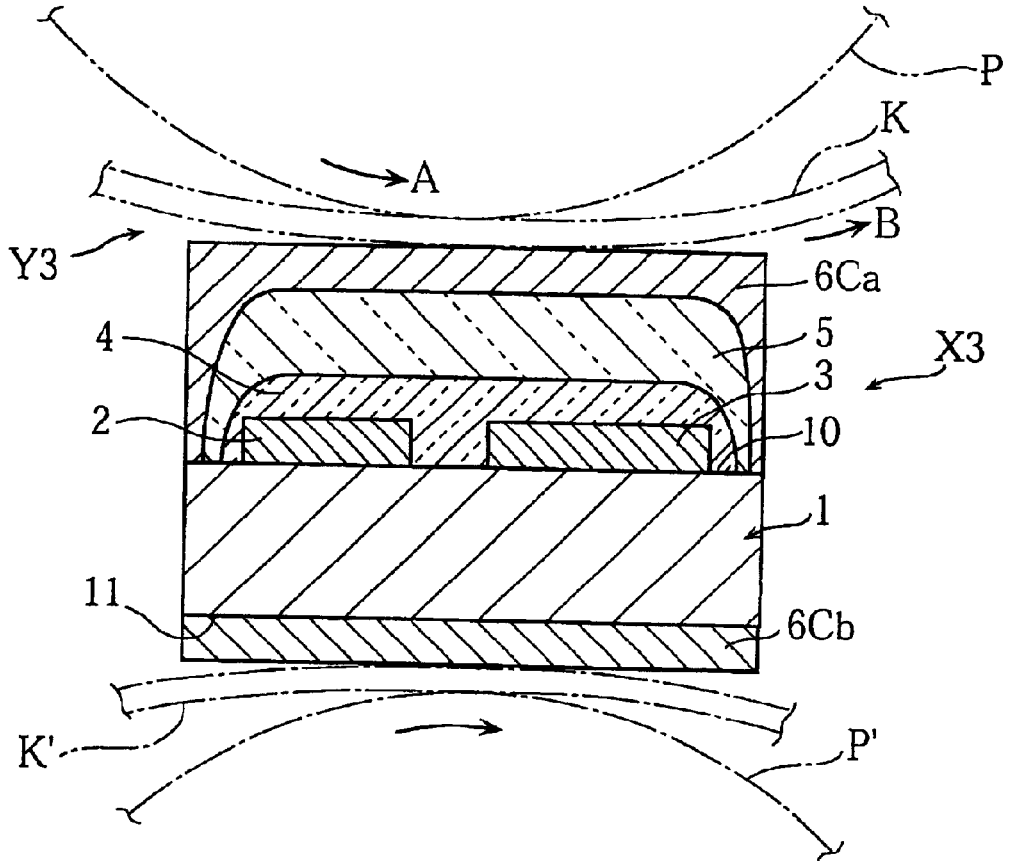
FIG. 4 is a sectional view showing a heater according to a third embodiment of the present invention.

FIG. 4 shows a heater X3 (and fixing unit Y3) according to a third embodiment of the present invention. As illustrated, the heater X3 includes a heat conducting layer 6Ca (covering the inner glass layer 5) and another heat conducting layer 6Cb (formed on the lower surface 11 of the base 1).

In the heater X3, the heat generated by the heating elements 2, 3 is conducted toward both the upper conductor layer 6Ca and the lower conductor layer 6Cb. Thus, the fixing unit Y3 with the heater X3 incorporated can perform simultaneous toner-fusing operations on its upper and lower sides. As shown in FIG. 4, recording paper K is brought into sliding contact with the upper layer 6Ca by a first platen roller P, while another recording paper K' is brought into sliding contact with the lower layer 6Cb by a second platen roller P'.

In the heater X3, the inner glass layers 4, 5 and the base 1 have a relatively low thermal conductivity than the heat-conducting layers 6Ca, 6Cb. Thus, the layers 4, 5 and the base 1 can serve as a heat reservoir for the heat generated by the heating elements 2, 3. Due to the reserved heat, the heat supply portions of the heater X3 can be heated with an immediate response upon application of the driving voltage to the heating elements 2, 3.

In the heater X3, either one of the two outer layers 6Ca and 6Cb may have a thermal conductivity lower than that of the supporting base 1, while the other layer (say, the upper layer 6Ca) may remain to be a good heat conductor. In this case, the heat generated by the heating elements 2, 3 is mostly conducted toward the upper layer 6Ca, whereby the upper layer 6Ca can be heated up to the desired temperature with a more immediate response. This is advantageous to achieving high-speed printing.

FIGS. 5~8 show heaters X4~X7 (fixing units Y4~Y7) according to fourth~seventh embodiments of the present invention, respectively. In the heaters X4~X7, a heat-conducting layer 6D, 6Ea, 6Fa, 6Ga is interposed between the heating elements 2, 3 and the supporting base 1.

Figure 5:
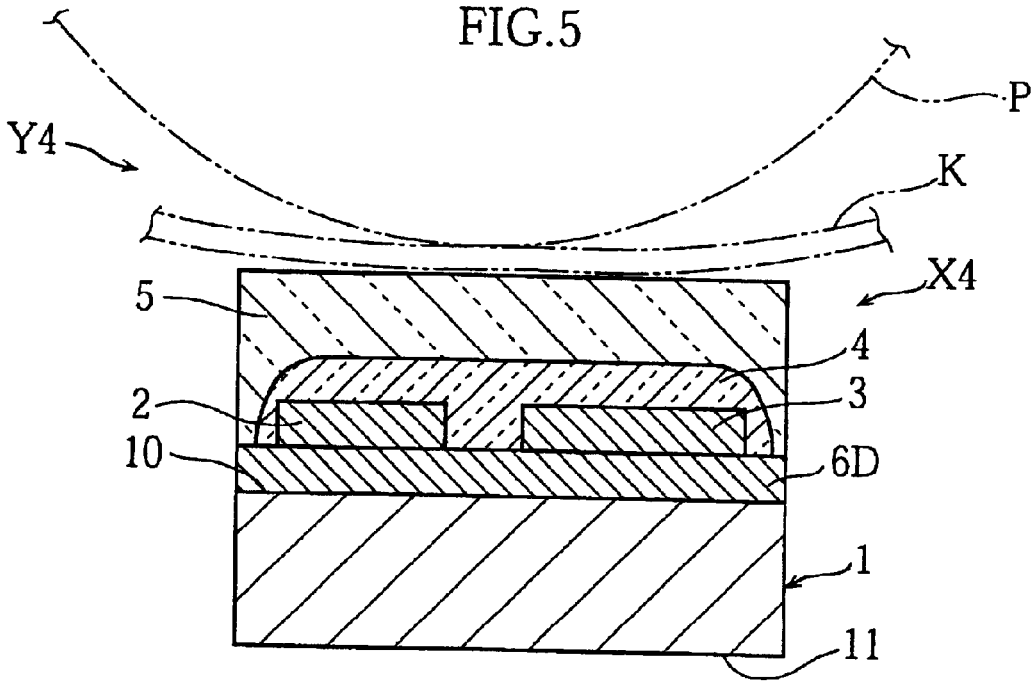
FIG. 5 is a sectional view showing a heater according to a fourth embodiment of the present invention.

Specifically, in the heater X4 of FIG. 5, a good heat conductor layer 6D is arranged between the heating elements 2, 3 and the supporting base 1. Recording paper K is brought into sliding contact with the outer glass layer 5 by the pressing action of a platen roller P.

With the above arrangement, the heat generated by the heating elements 2, 3 is first conducted through the heat conductor layer 6D and then passed to the supporting base 1. In this manner, the base 1 as a whole can be heated up more uniformly than when no such intermediate heat conductor is provided between the heating elements 2, 3 and the base 1. Accordingly, the base 1 should only bear subdued thermal stress which is too weak to damage the base 1.

Figure 6:
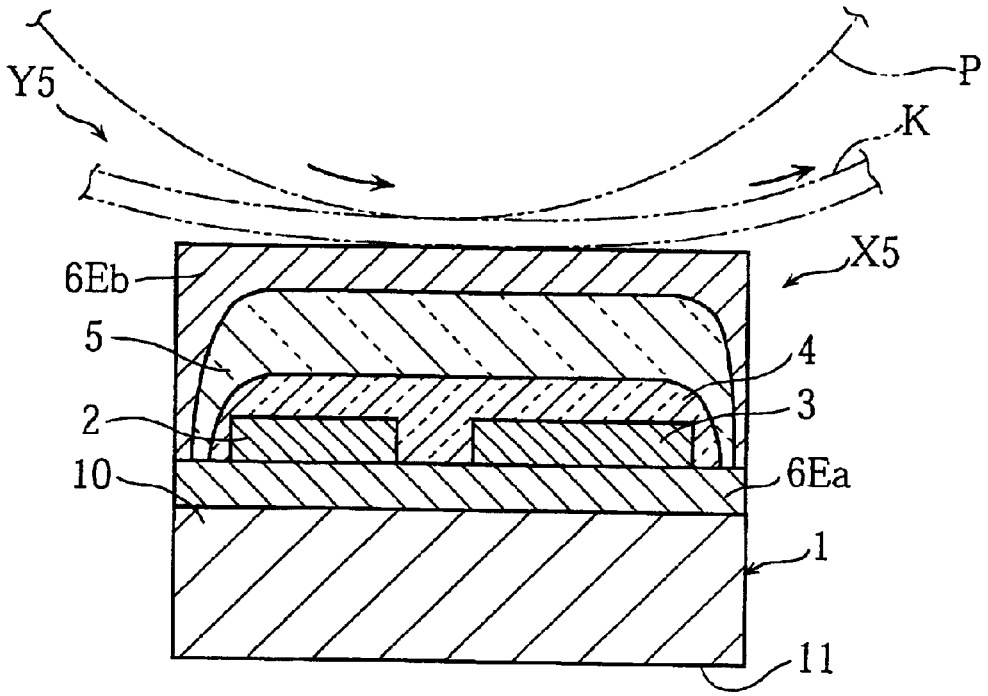
FIG. 6 is a sectional view showing a heater according to a fifth embodiment of the present invention.

Referring now to FIG. 6, in the heater X5 of the fifth embodiment, a highly heat-conductive layer 6Ea is provided between the heating elements 2, 3 and the base 1. In addition, a highly heat-conductive layer 6Eb is formed on the glass layer 5. Recording paper K is brought into sliding contact with the heat conductor layer 6Eb by a platen roller P.

Since the heat conductor layer 6Ea is provided, as in the above-described heater X4, it is possible to prevent the base 1 from suffering any severe thermal stress. Meanwhile, the heat conductor layer 6Eb promotes the heat conduction from the heating elements 2, 3 toward the layer 6Eb. Thus, in operation, the heat conductor layer 6Eb can be heated up to the desired temperature with an immediate response. In this embodiment again, the inner glass layers 4, 5 serve as a heat reservoir that contributes to quick heating of the heat conductor layer 6Eb after the power supply to the heating elements 2, 3 resumes.

In the heater X5 of FIG. 6, the outermost layer 6Eb may have a relatively low thermal conductivity so that the heat conduction from the heating elements 2, 3 toward the layer 6Eb is subdued. As a counteraction, the generated heat flows toward the lower surface 11 of the base 1. Though not shown in the figure, recording paper may be brought into sliding contact with the lower surface 11 by a platen roller for toner fixation.

Figure 7:
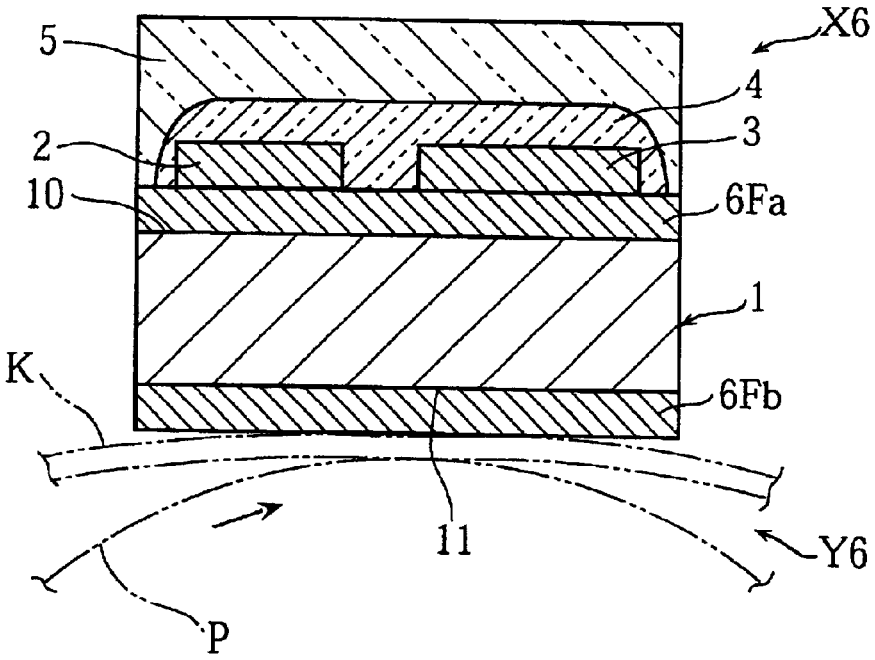
FIG. 7 is a sectional view showing a heater according to a sixth embodiment of the present invention.

Referring now to FIG. 7, in the heater X6 of the sixth embodiment, a highly heat-conductive layer 6Fa is interposed between the heating elements 2, 3 and the base 1, while another highly heat-conductive layer 6Fb is provided on the lower surface 11 of the base 1. Recording paper K is brought into sliding contact with the lower surface 11 by a platen roller P.

In the heater X6 again, the interposed heat conductor layer 6Fa protects the supporting base 1 from thermal damage. Further, the lower heat conductor layer 6Fb promotes the heat conduction from the heating elements 2, 3 toward the layer 6Fb. Accordingly, the layer 6Fb can be heated so quickly as to achieve high-speed printing.

In the heater X6, the lower layer 6Fb may have a relatively low thermal conductivity. In this instance, the downward heat conduction from the heating elements 2, 3 is restricted, while the upward heat conduction is promoted. Thus, recording paper is brought into sliding contact with the upper glass layer 5 by a non-illustrated platen roller.

Figure 8:
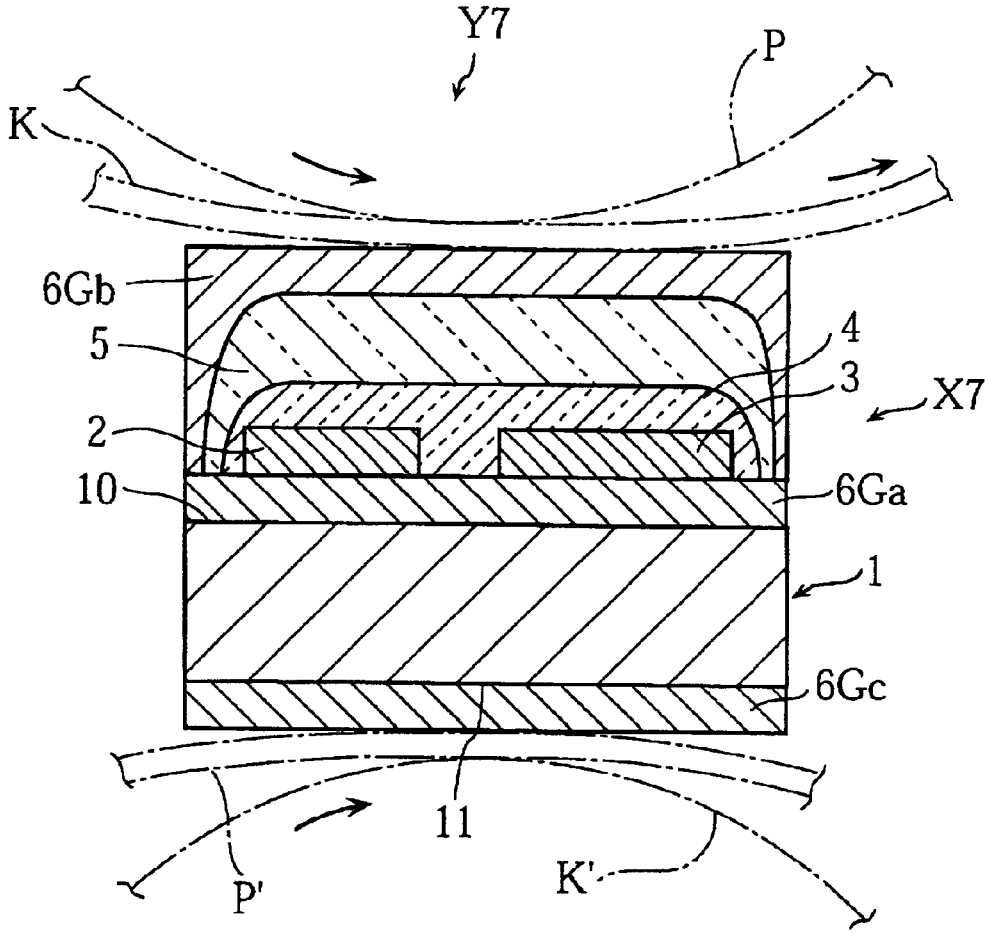
FIG. 8 is a sectional view showing a heater according to a seventh embodiment of the present invention.

Referring now to FIG. 8, the heater X7 of the seventh embodiment includes three heat-conducting layers 6Ga, 6Gb and 6Gc made of a highly heat-conductive material. The first conducting layer 6Ga is interposed between the heating elements 2, 3 and the base 1, the second conducting layer 6Gb is formed on the inner glass layers 4~5, and the third conducting layer 6Gc is provided on the lower surface 11 of the base 1. In this embodiment again, the interposed conductor layer 6Ga causes the base 1 to be heated up uniformly by the heat from the heating elements, thereby preventing the base 1 from being thermally damaged. Further, the heat generated by the heating elements 2, 3 can be conducted quickly to both the upper and the lower conductor layers 6Gb, 6Gc. Due to this quick heat conduction and the heat-reserving function of the base 1 and glass layers 4~5, the prescribed heat-supplying portions of the heater X7 can be heated up with an immediate response. The heater X7 may be used for toner fixation to be performed on the side of the upper conductor layer 6Gb (see the double-dot chain lines) and/or on the side of the lower conductor layer 6Gc (see the single-dot chain lines). A platen roller P holds recording paper K in sliding contact with the upper conductor layer 6Gb, and another platen roller P' holds recording paper K' in sliding contact with the lower conductor layer 6Gc.

In the heater X7, either one of the heat conductor layers 6Gb and 6Gc may have a relatively low thermal conductivity. In this case, the heat generated by the heating elements 2, 3 is mostly conducted toward the other layer (say, the upper layer 6Gb) having a higher thermal conductivity. Accordingly, recording paper K is brought into sliding contact with the better heat conductor layer by a platen roller.

The above-described first~seventh embodiments include two glass layers 4 and 5. The present invention, however, is not limited to this particular arrangement. For instance, no glass layer may be provided, or only one or more than two layers may be provided.

Figure 9:
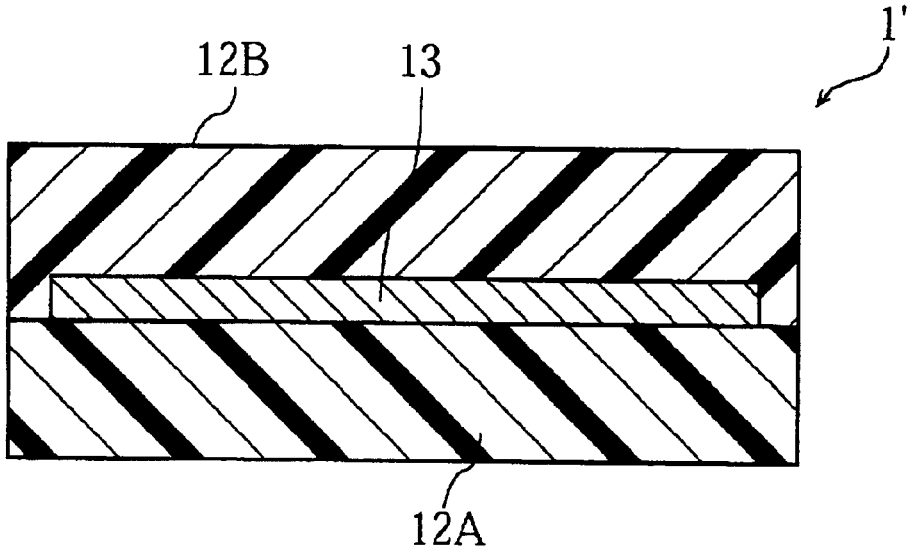
FIGS. 9 and 10 are sectional views showing some examples of a supporting base used for the heater of the present invention.

According to the present invention, the supporting base 1 does not necessarily have a single layer structure. For instance, as shown in FIG. 9, a supporting base 1' may have a three-layer structure consisting of a first heat-insulating layer 12A, a heat conductor layer 13 formed on the first layer 12A, and a second heat-insulating layer 12B to enclose the heat conductor layer 13. The first and the second heat-insulating layers 12A, 12B may be made of a heat-resistant organic material such as epoxy resin or polyimide resin. The heat conductor layer 13 may be made of metal such as silver, aluminum or stainless steel.

Figure 10:
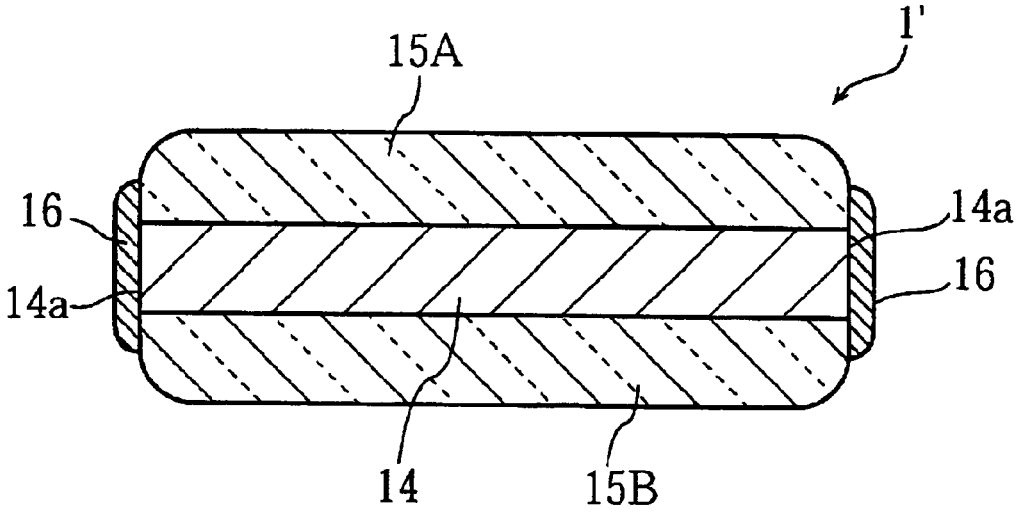
Figure 11:
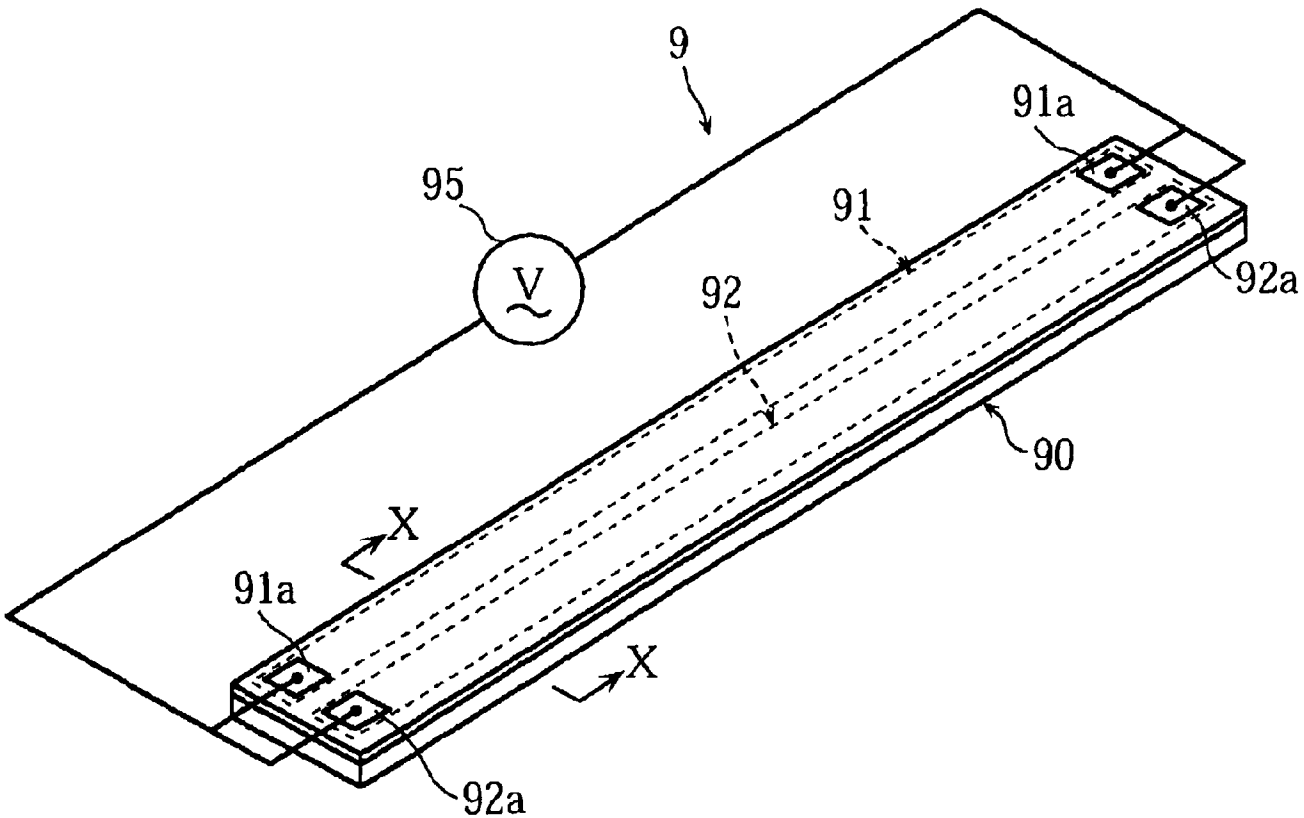
FIG.11 PRIOR ART
FIG. 11 is a perspective view showing a conventional heater used for toner fixation.
Figure 12:
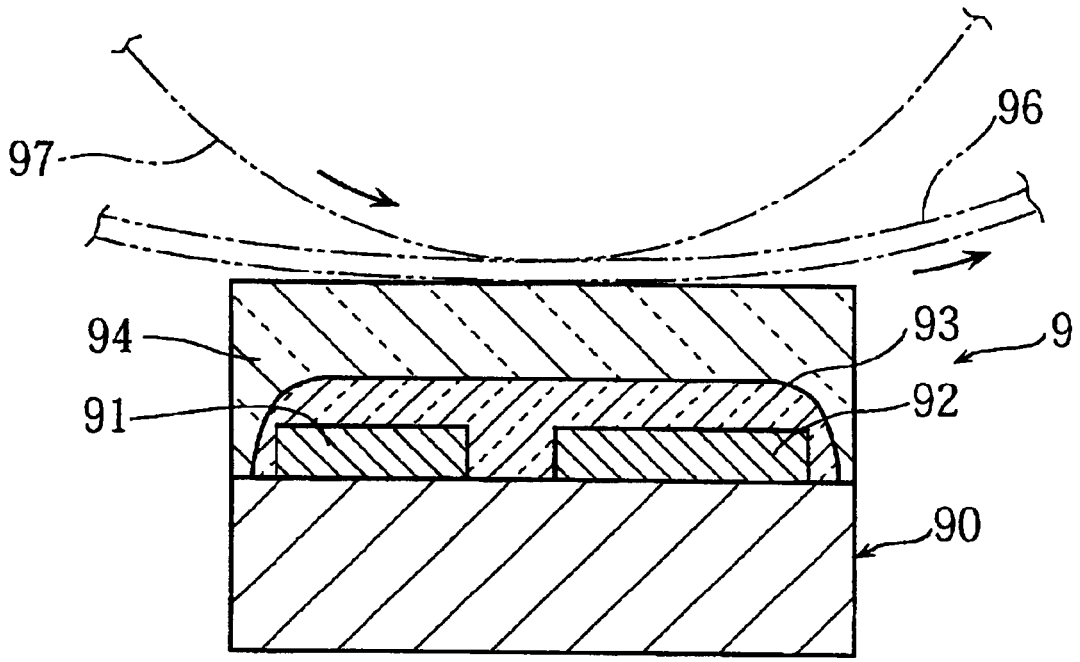
FIG.12 PRIOR ART
FIG. 12 is a sectional view taken along lines X—X in FIG. 11.

As another example, referring to FIG. 10, a base 1' may be made up of two insulating layers 15A~15B and a highly heat-conductive layer 14 interposed between the upper and the lower glass layers 15A, 15B. The upper and the lower layers 15A, 15B may be made of an inorganic material such as glass. The interposed layer 14 may be made of metal such as silver, aluminum or stainless steel. In this example, the interposed layer 14 has its side surfaces 14*a* exposed from the upper and the lower layers 15A, 15B. Preferably, these side surfaces 14*a* may be covered by an insulating member 16, as illustrated in FIG. 10.

When use is made of the supporting base 1' (shown in FIG. 9 or 10) in place of the single-layer base 1 in the heater X1~X7, the heat-conducting layer (which is provided on the upper or lower surface of the base 1) may not necessarily be provided.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A heater comprising:

a supporting base including a first surface and a second surface opposite to the first surface, the base having a predetermined thermal conductivity;

a heating element formed on the first surface;

a heat conductor provided on a side of the first surface and having a thermal conductivity greater than the thermal conductivity of the base; and a glass layer interposed between the first surface and the heat conductor.

2. A heater comprising:

a supporting base including a first surface and a second surface opposite to the first surface, the base having a predetermined thermal conductivity;

a first heating element formed on the first surface; and a heat conductor provided on the second surface and having a thermal conductivity greater than the thermal conductivity of the base;

wherein the heat conductor entirely covers the second surface.

3. The heater according to claim 1, wherein the heat conductor is provided between the first surface and the heating element.

4. The heater according to claim 1, wherein the base is made of an insulating material including $Al_2O_3$, the heat conductor being made of an insulating material including one of SiC, AlN, Ag, Al, BN and WC.

5. The heater according to claim 1, wherein the base is made of an insulating material including AlN, the heat conductor being made of an insulating material including SiC.

6. A heater comprising:

a supporting base including a first surface and a second surface opposite to the first surface, the base having a predetermined thermal conductivity;

a heating element formed on the first surface; and a heat conduction restrictor provided on a side of the second surface and having a thermal conductivity lower than the thermal conductivity of the base.

7. A method of making a heater, the method comprising the steps of:

preparing a supporting base including a first surface and a second surface opposite to the first surface, the base having a predetermined thermal conductivity;

forming a heating element on the first surface;

forming a glass layer to cover the heating element; and providing a heat conductor on a side of the first surface of the base, the heat conductor having a predetermined thermal conductivity greater than the thermal conductivity of the base;

wherein the glass layer is interposed between the first surface and the heat conductor.

8. The method according to claim 7, wherein the heat conductor is formed by one of sputtering, spraying, plating and screen printing.

9. A method of making a heater, the method comprising the steps of:

preparing a supporting base including a first surface and a second surface opposite to the first surface, the base having a predetermined thermal conductivity;

forming a heating element on the first surface;

forming a glass layer to cover the heating elements; and providing a heat conductor on the second surface of the base, the heat conductor having a predetermined thermal conductivity greater than the thermal conductivity of the base;

wherein the heat conductor entirely covers the second surface of the base.

10. The heater according to claim 2, wherein the heat conductor includes a flat surface that comes into sliding contact with recording paper for toner fusing.

11. The heater according to claim 10, wherein the flat surface of the heat conductor includes a central contact region and two non-contact regions flanking the contact region, the contact region coming into sliding contact with the recording paper, the non-contact regions being spaced apart from the recording paper.

12. The heater according to claim 6, further comprising a heater conductor provided on a side of the first surface and having a thermal conductivity greater than the thermal conductivity of the base.

* * * * *